US008698394B2

(12) United States Patent
McCutcheon et al.

(10) Patent No.: US 8,698,394 B2
(45) Date of Patent: Apr. 15, 2014

(54) ELECTRONIC ARTICLES FOR DISPLAYS AND METHODS OF MAKING SAME

(75) Inventors: Jeffrey W. McCutcheon, Baldwin, WI (US); John D. Le, Woodbury, MN (US); Nelson T. Rotto, Woodbury, MN (US); Badri Veeraraghavan, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 13/635,445

(22) PCT Filed: Mar. 18, 2011

(86) PCT No.: PCT/US2011/028939

§ 371 (c)(1),
(2), (4) Date: Sep. 17, 2012

(87) PCT Pub. No.: WO2011/123263

PCT Pub. Date: Oct. 6, 2011

(65) Prior Publication Data

US 2013/0009544 A1 Jan. 10, 2013

Related U.S. Application Data

(60) Provisional application No. 61/319,323, filed on Mar. 31, 2010.

(51) Int. Cl.

| | |
|---|---|
| ***H01J 1/62*** | (2006.01) |
| ***H01J 63/04*** | (2006.01) |
| ***H01J 17/49*** | (2012.01) |

(52) U.S. Cl.

USPC ..... 313/509; 445/24; 313/483; 313/498; 313/505; 313/506

(58) Field of Classification Search

None

See application file for complete search history.

(56) References Cited

U.S. PATENT DOCUMENTS

| | | | |
|---|---|---|---|
| 4,067,884 | A | 1/1978 | Martini |
| 4,612,242 | A | 9/1986 | Vesley |

(Continued)

FOREIGN PATENT DOCUMENTS

| | | |
|---|---|---|
| DE | 102008004942 | 6/2009 |
| EP | 1150311 | 10/2001 |

(Continued)

OTHER PUBLICATIONS

Lu, "Dielectric Loss Control of High-K Polymer Composites by Coulomb Blockade Effects of Metal Nanoparticles for Embedded Capacitor Applications", *School of Materials* Science and Engineering, Packaging Research Ctr., Georgia Institute of Tech., Atlanta, GA, 2005, 6 pages.

(Continued)

*Primary Examiner* — Natalie Walford
(74) *Attorney, Agent, or Firm* — Yen Tong Florczak

(57) ABSTRACT

Electronic articles such as, for example, electroluminescent lamps useful for displays and method of making the same are provided. The electronic articles include a substrate, a conductive element adjacent to the substrate, a high dielectric composite adjacent to the conductive element and an electrically-active layer adjacent to at least a portion of the high dielectric composite. The high dielectric composite includes a polymeric binder and from 1 to 80 volume percent of filler retained in the binder. The filler comprises particles that include an electrically-conducting layer and an insulating layer substantially surrounding the electrically-conducting layer. In some embodiments the binder includes a pressure-sensitive adhesive and the composite has adhesive properties.

19 Claims, 2 Drawing Sheets

(56) References Cited

U.S. PATENT DOCUMENTS

| | | | | |
|---|---|---|---|---|
| 5,586,892 | A | 12/1996 | Sato | |
| 5,635,293 | A | 6/1997 | Korleski | |
| 5,756,936 | A | 5/1998 | Viebranz | |
| 6,339,111 | B1 | 1/2002 | Moon | |
| 6,436,532 | B1 | 8/2002 | Moon | |
| 6,498,547 | B2 | 12/2002 | Morita | |
| 6,562,448 | B1 | 5/2003 | Chamberlain | |
| 6,919,126 | B2 * | 7/2005 | Wu et al. | 428/323 |
| 6,924,971 | B2 * | 8/2005 | Satsu et al. | 361/311 |
| 7,060,350 | B2 * | 6/2006 | Takaya et al. | 428/323 |
| 7,078,095 | B2 | 7/2006 | Tam | |
| 7,215,473 | B2 | 5/2007 | Fleming | |
| 7,566,494 | B2 | 7/2009 | Jun | |
| 2001/0046021 | A1 | 11/2001 | Kozuka | |
| 2004/0003839 | A1 | 1/2004 | Curtin | |
| 2004/0247858 | A1 | 12/2004 | Wu | |
| 2005/0255692 | A1 | 11/2005 | Yang | |
| 2007/0146426 | A1 | 6/2007 | Nelson | |
| 2008/0187651 | A1 | 8/2008 | Lee | |
| 2008/0218075 | A1 | 9/2008 | Tyldesley | |
| 2009/0303602 | A1 | 12/2009 | Bright | |

FOREIGN PATENT DOCUMENTS

| | | |
|---|---|---|
| EP | 1231637 | 8/2002 |
| EP | 1855508 | 11/2007 |
| JP | 11071560 | 3/1999 |
| JP | 2003-077335 | 3/2003 |
| JP | 2004-043602 | 2/2004 |
| JP | 2004-095269 | 3/2004 |
| JP | 2006-054066 | 2/2006 |
| JP | 2006-299177 | 11/2006 |
| JP | 2009-102731 | 4/2009 |
| JP | 2009-170414 | 7/2009 |
| JP | 2009-259804 | 11/2009 |
| JP | 4386145 | 12/2009 |
| JP | 2010-010142 | 1/2010 |
| KR | 2006-035249 | 4/2006 |
| KR | 2006-036165 | 4/2006 |
| KR | 2008-058610 | 12/2006 |
| KR | 2008-098815 | 11/2008 |
| KR | 2009-073366 | 7/2009 |
| WO | WO 01-29920 | 4/2001 |
| WO | WO 2008-014169 | 1/2008 |
| WO | WO 2009-078469 | 6/2009 |

OTHER PUBLICATIONS

Vo, "Dielectric Polymers Embedded with High-k Coated Conducting Particles: Effective Dielectric Properties Modeling", Advanced Packaging Materials: Processes, Properties and Interfaces, 2005, Proceedings, International Sumposium on Irvine, California, USA, Mar. 16-18, 2005, pp. 233-236.

International Search Report for PCT/US2011/028939, Mailed on Jul. 1, 2011, 4 pages.

* cited by examiner

ELECTRONIC ARTICLES FOR DISPLAYS AND METHODS OF MAKING SAME

CROSS REFERENCE TO RELATED APPLICATIONS

This application is a national stage filing under 35 U.S.C. 371 of PCT/US2011/028939, filed 18 Mar. 2011, which claims priority to U.S. Application No. 61/319,323 filed 31 Mar. 2010, the disclosure of which is incorporated by reference in its/their entirety herein.

FIELD

This disclosure relates to electronic articles useful for display devices and methods of making the articles.

BACKGROUND

Electrically-active materials are materials that respond to high electric fields and produce optical or mechanical effects. For example, electroluminescent devices include a phosphor layer (electrically-active material) that, when coupled to an electric field, can emit radiation, either directly or through an intermediate layer that absorbs the emitted energy and reemits it at a different wavelength. Typically, electroluminescent devices are made by depositing a conductive layer, which may be patterned, on a substrate, typically glass or a flexible polymer. An electrically-active material such as a phosphor can then be applied on top of the conductive layer. The layer, which contains the electrically-active layer, then is covered with a thin dielectric material to protect it from a transparent electrode which can be applied thereon. These types of devices, with two electrodes and an electrically-active layer sandwiched between them are capacitive devices and can store energy. It is critical with capacitive devices that the electric field created by one electrode can reach the other electrode in order to impart energy to the electrically-active layer. It is equally critical that there be no substantial conduction pathway between the two electrodes which would create a short-circuit and render the device inoperable.

Typically, dielectric or insulating materials are situated between the two plates in a capacitor or capacitive device. In order to support an electric field between the two plates, the dielectric needs to be very thin, have a high dielectric constant, or a combination of both. In some capacitive devices, inorganic materials having a very high dielectric constant have been employed as dielectric materials. For example, it is known to use barium titanate as a dielectric in electroluminescent devices. Non-conductive metal oxides such as aluminum oxide or titanium oxide can also be used as dielectrics in capacitive devices. Such inorganic dielectrics can be incorporated into capacitive device by vapor deposition techniques. Alternatively, composites can be formed by using a non-energy absorbing matrix or binder and including particles that have high dielectric constant therein. Since typical binders have relatively low dielectric constants, it is necessary to include a large volume of filler particles in the binder to get a high enough dielectric constant to support the electric field in the capacitive device.

SUMMARY

Thus, there is a need for insulating materials, useful in electronic devices, that have a high dielectric constant with low dielectric loss but also have very low conductivity. Electronic devices such as capacitors, actuators, artificial muscles and organs, smart materials and structures, micro-electro-mechanical (MEMS) devices, micro-fluidic devices, acoustic devices and sensors, which are capacitive devices, have increased the need for a variety of new and better insulating materials. There is also a need in the field of electronic devices for simpler, more economical, manufacturing processes to produce such devices.

In one aspect, an electronic article is provided that includes a substrate, a conductive element adjacent to the substrate, a high dielectric composite, having a first and a second surface, the first surface adjacent to at least a portion of the conductive element; and an electrically-active layer which is adjacent to at least portion of the second surface of the high dielectric composite, wherein the high dielectric composite comprises a polymeric binder, and from 1 to 80 volume percent of particulate filler retained in the binder, wherein the filler comprises particles that include an electrically-conducting layer and an insulating layer substantially surrounding the electrically-conducting layer. The substrate can be a polymeric substrate such as, for example, polyimide. The conductive element can be patterned. The binder can be a thermoplastic or thermosetting resin such as an epoxy resin, a cyanate resin, a polybutadiene resin, or an acrylic resin. The binder can also be a pressure-sensitive adhesive comprising the reaction product of acrylic precursors.

The filler particles can further include a core body that can be in the form of a sphere, spheroid, a flake, or a fiber. The core body can be a ceramic or a polymer and, if a ceramic, can include silicon dioxide. The core body can be substantially hollow. The electrically-conducting layer can include a metal, a metal alloy, or a conductive metal oxide. In some embodiments, the metal can be aluminum or silver. The insulating layer can be a ceramic or a polymer and can include the same material as the core body. In some embodiments, the insulating layer can include aluminum oxide or silicon oxide. The provided composition can include surface-modified nanoparticles and can have a dielectric constant greater than about 4.

In another aspect, a method of assembling a display device is provided that includes disposing a conductive element adjacent to a substrate to form a conductive substrate, disposing a transparent conductor adjacent to a transparent substrate, disposing an electrically-active layer adjacent to the transparent conductor to form a transparent electrically-active substrate, applying a high dielectric composite adjacent to either the conductive element on the conductive substrate, the electrically-active layer on the transparent electrically-active substrate or both, and laminating the conductive substrate to the transparent electrically-active substrate so that the high dielectric composite is adjacent to both the conductive element on the conductive substrate and the electrically-active layer on the transparent electrically-active substrate to form the display device.

Also provided are displays for electronic devices that include the provided compositions. Furthermore, electronic devices are provided that include such displays.

In this disclosure:

"adjacent" refers to layers which are in proximity with one another—having three or less layers between them;

"binder" refers to a network of polymeric material which may be continuous or discontinuous, cross-linked or uncross-linked and may include voids and/or a gas;

"ceramic" refers to a hard, brittle material that is made by applying heat to a non-metallic mineral;

"electrically-active layer" refers to a layer of material or materials that can interact with a nearby electric field by direct contact or though a field-effect;

"electrically-conducting" refers to materials having a resistivity between about $10^{-6}$ to 1 ohm-cm;

"in electrical communication with" refers to a first material positioned within the electrical field of a second, electric-field generating material allowing energy generated by the second material to be transferred to the first material either directly or through a field effect;

"filler" refers to coated or uncoated particles which may be hollow or solid and which may be made from inorganic materials such as glass or ceramics or organic materials such as polymers and may be in various shapes such as spheres, spheroids, fibers, and/or flakes;

"laminate" or "laminating" refers to placing two layers together with an applied force; they may be in direct contact with one another or adjacent to one another after lamination;

"substantially hollow" means encompassing some void or gas;

"non-conducting" refers to materials that are not electrically-conducting; and

"spheroids" refer to particles that are shaped like a sphere but not perfectly round.

The provided electronic articles and methods fulfill the need for capacitive electronic devices that require dielectric materials with high dielectric constant. The provided methods allow manufacture of the provided devices using a simple, economical process that involves lamination of two or more parts of the device using high dielectric materials.

The above summary is not intended to describe each disclosed embodiment of every implementation of the present invention. The brief description of the drawings and the detailed description which follows more particularly exemplify illustrative embodiments.

DETAILED DESCRIPTION

Figure 1:
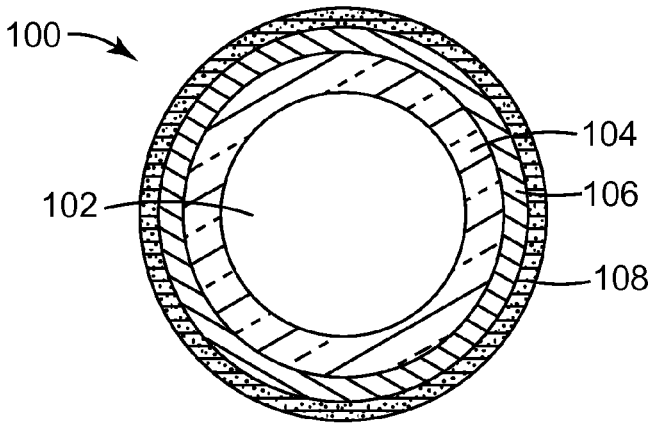
FIG. 1 is a schematic of a particle included in fillers useful in some embodiments of provided electronic articles.

In the following description, reference is made to the accompanying set of drawings that form a part of the description hereof and in which are shown by way of illustration several specific embodiments. It is to be understood that other embodiments are contemplated and may be made without departing from the scope or spirit of the present invention. The following detailed description, therefore, is not to be taken in a limiting sense.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

An electronic article is provided. The electronic article can include a substrate upon which a conductive element is disposed. The conductive element can be in direct contact with the substrate or adjacent to the substrate. Typically, the provided electronic article is a component of a capacitive electronic device. Capacitive electronic devices include, for example, capacitors, actuators, artificial muscles and organs, smart materials and structures, micro-electro-mechanical (MEMS) devices, micro-fluidic devices, acoustic devices, electroluminescent lamps, electronic ink and paper, electronic readers, and sensors. The substrate can be any non-conductive material that can support a conductive element disposed thereon. The substrate can have a substantially flat surface and can be rigid or flexible. Examples of rigid substrates include glass, ceramics, or crystalline materials that have geometrically stable surfaces at the temperatures of operation of the capacitive electronic device. Examples of flexible substrates include thermoplastic films such as polyesters (e.g., PET), polyacrylates (e.g., poly(methyl methacrylate), PMMA), polycarbonates, polypropylenes, high or low density polyethylenes, polyethylene naphthalates, polysulfones, polyether sulfones, polyurethanes, polyamides, polyvinyl butyral, polyvinyl chloride, polyvinylidenedifluoride (PVDF), fluorinated ethylene propylene (FEP), and polyethylene sulfide; and thermoset films such as cellulose derivatives, polyimides, polyimide benzoxazoles, polybenzoxazoles, and high $T_g$ cyclic olefin polymers. The supports can also include a transparent multilayer optical film ("MOF") provided thereon with at least one crosslinked polymer layer, such as those described in U.S. Pat. No. 7,215,473 (Fleming). polymeric substrates such as polyesters, polyacetates, polyacrylics, polyimides, or any other polymeric materials, typically in sheet or web form that are insulating and can support the application of a conductive element upon them.

In some embodiments, the conductive element can be applied at ambient temperatures and pressures as a liquid solution. For example, U.S. Pat. Appl. No. 2007/0146426 (Nelson et al.) discloses thin film transistors made from ink jet printed layers that include conductive inks for conductive elements of the transistors. And, U.S. Pat. App. No. 2008/0187651 (Lee et al.) discloses conductive ink formulations that include conductive metallic nanoparticles which are useful as conductive elements in electronic devices. Furthermore, U.S. Pat. Appl. No. 2008/0218075 (Tyldesley et al.) discloses the use of silver conductive inks in electroluminescent displays. In other embodiments, conductive elements can be applied by electroless plating methods which are well known to those of ordinary skill in the art. In some embodiments, the conductive element can be applied by vapor deposition methods such as evaporation or magnetron sputtering.

In some embodiments, conductive elements can include highly conductive metals. Typical highly conductive metals include elemental silver, copper, aluminum, gold, palladium, platinum, nickel, rhodium, ruthenium, aluminum, and zinc. Alloys of these metals such as silver-gold, silver-palladium, silver-gold-palladium, or dispersions containing these metals in admixture with one another or with other metals also can be employed. Other useful materials for conductive elements can be transparent conductive metal oxides (TCOs) such as indium oxide, indium-tin oxide, indium-zinc oxide, zinc oxide with other dopants such as gallium and/or boron, zinc-tin oxide (zinc stannates), or other TCOs, or combinations thereof. Useful materials for substrates and conductive elements that can be employed in the provided electronic articles are disclosed, for example, in U.S. Pat. Publ. No. 2009/0303602 (Bright et al.).

The conductive elements can be patterned. By patterned it is meant that the conductive elements can have a configuration or configurations or the process of making such configurations that can include regular arrays or random arrays of features or structures or a combination of both. The pattern can be generated using patterning techniques such as anodization, photo-replication, laser ablation, electron beam lithography, nanoimprint lithography, optical contact lithography, etching, projection lithography, optical interference lithography, and inclined lithography. The pattern can then be transferred into the substrate by removing existing substrate material using subtractive techniques such as wet or dry etching, if necessary. The pattern can be transferred into the substrate by wet or dry etching of a resist pattern. Resist patterns can be made from a variety of resist materials including positive and negative photoresists using methods known by those skilled in the art. Wet etching can include, for example, the use of an acid bath to etch an acid-sensitive layer or the use of a developer to remove exposed or unexposed photoresist. Dry etching can include, for example, reactive ion etching, or ablation using a high energy beam such as, for example, a high energy laser, or ion beam. The patterned conductive elements can be directly deposited on the substrate through a mask or by direct printing methods.

The provided electronic articles include a high dielectric composite that comprises a polymeric binder and from 1 to 80 volume percent of particulate filter retained in the binder. High dielectric composites can include binders that are thermoplastic adhesives such as hot-melt adhesives, thermosetting adhesives, or a screen-printable material. A screen-printable material is a relatively low molecular weight polymer that may or may not be cross-linked but has a viscosity that can stabilize dispersed fillers retained within it and can be screen-printed onto a component of the provided electronic article. Typically, the high dielectric composite, when it is an adhesive, is pressure-sensitive when filled. Combinations of any non-adhesive, adhesive, or screen-printable binders are also contemplated.

High dielectric composites are composites that have a low density, low microwave loss (dielectric loss), and high dielectric constant. High dielectric composites can be useful in electronic devices, such as capacitive devices. Such high dielectric composites can have a dielectric constant of from about 4 to about 10,000, from about 4 to about 100, from about 4 to about 50, or from about 8 to about 30 when measured according to the disclosed test methods. Additionally, useful high dielectric composites for the provided electronic articles can have loss tangents of less than 5.0, less than 1.0, less than 0.5, less than 0.1, and even less than 0.02 when measured according to the disclosed test methods. Capacitive devices, typically, include two substantially parallel plates (electrodes) that are located close to each other but have insulating material between the plates and define an X-Y plane. The Z-direction is normal to the X-Y plane and defines the general direction of the electric field in the absence of an added dielectric material between the plates. Additionally, capacitive devices can have one or more electrically-active materials between the plates. It is important that the two plates be close enough together so that an electric field generated at one plate reaches the other plate. But it is also important that any charge built up on one plate remains on that plate and is not transferred to the other plate thus creating a "short". The simplest insulating material for capacitors is air. Air has a dielectric constant of unity and is non-conductive. But the low dielectric constant of air requires that the two plates in the capacitor be very large in area and very close together in order to have appreciable charge storage or capacitance Thus, it is desirable to have filler materials having a high dielectric constant between the plates in order to enable the two plates to be physically farther apart but to allow the electric field generated at one plate to substantially over lap the other plate for higher capacitance or device miniaturization. Typically, in the provided electronic devices, the capacitive plates can be from about 5 μm to about 200 μm, from about 5 μm to about 100 μm, from about 5 μm to about 50 μm, or even from about 5 μm to about 25 μm apart.

The provided high dielectric composite can act as an electric field "lens" to help focus the electric field emanating from the conductive element in the X-Y plane and the Z-direction, electrically-active Layer (EAL). The "lens" effect of the dielectric composite has two primary parameters that influence the "lens" effectiveness for the EAL performance—the dielectric constant and the dielectric loss tangent. The dielectric constant of the dielectric composite influences the electric field strength at the EAL and the loss tangent is a measure of the electric field that is dissipated and does not benefit the EAL.

In general, composites with ever increasing higher dielectric constant can focus the field more strongly in the X-Y plane and the Z-direction on the target layer, up to a limit. However, if the dielectric constant of the composite it too high, then the field may not be efficiently focused by the "lens" effect on the desired EAL. The high dielectric composite also can cause electric field loss due to resistive heat dissipation as associated with the loss tangent. So, for a given electronic article there is an optimum dielectric constant and loss property (measured as loss tangent) that helps focus the electric field, with minimal loss, on the electrically active layer.

The high dielectric constant composite has a volume influence on the electric field in the X, Y, and Z-direction as defined above. Thus, the dielectric composite can be optimized for a given application to adjust the dielectric constant and loss tangent, anisotropically. Test methods can be used to derive results based on a specific test method and these results can be useful in determining performance values that can be used to design articles having dielectric composites with the appropriate anisotropic electrical properties for a given end use application. Thus, one skilled in the art as, needed can, devise a new test method, if desired, to determine the dielectric constant and the dielectric loss tangent for each specific volume of dielectric composite. An alternate approach can be to use the test methods provided herein to optimize the material set and test the final volume of the dielectric material in the end use application assembly.

The dielectric constant and loss tangent may be optimized to different effective performance levels in the Z-direction or X-Y plane, or in between. As an example, in a specific applications the dielectrics composite can have a dielectric constant of 8 to 25 in the X-Y plane and a loss tangent of <0.5 and a dielectric constant ranging from 4-1000 and the loss tangent is <0.1 in the Z-direction. In a given application, the dielectric constant of the dielectric composite can vary in a ratio of Z to X-Y or X-Y to Z of 1:1, 1:2, 1:3, even 1:4 to 1:10 or more. The loss tangent can also vary in a ratio of Z to X-Y or X-Y to Z of 1:1, 1:2, 1:3, even 1:4 to 1:10 or more depending on the end use application needs.

The provided high dielectric composites can act as an electric field "lens" to help focus the electric field emanating from the conductive element and projecting towards the electrically-active layer. In general, composites with higher dielectric constant can focus the field more strongly on the target (electrically-active) layer. However, if the dielectric constant of the composite it too high, then the field might not be efficiently absorbed by the desired target layer. The high dielectric composite also can cause electric field loss due to resistive heat dissipation. So, for a given electronic article there is an optimum dielectric constant and loss property (measured as loss tangent) that helps focus the electric field, with minimal loss, on the electrically active layer.

It is well known to use polymers as insulators (dielectrics) between capacitive plates. It is also known to add fillers having high dielectric constants to the polymers in order to increase the dielectric constant of the filler-polymer composite. It is common practice in the electronics industry, for example, to make high dielectric composites for use as insulators by using a polymer binder and high dielectric inorganic filler or metal filler. For example, polymers can be loaded with particulate fillers that include a discontinuous layer of electrically-conducting material such as occurs when a metallic coating forms beads on the surface of, for example, glass bubbles. Alternatively, the particulate fillers may have a continuous coating of electrically-conducting material substantially surrounding a core body. Core bodies can include glass bubbles, ceramic fibers, acicular fibers, ceramic or glass microspheres, ceramic or glass spheroids, flakes of ceramic materials, or other small chunks of high dielectric materials of various shapes and sizes. Core bodies can be solid or can be substantially hollow. Exemplary ceramic materials include silicon dioxide, barium titanate, and titanium dioxide. For such composite materials, the strength of the electric field communication between the two plates (usually measured as dielectric loss) is affected by the metal thickness, the metal type, the filler shape, the filler size, the microwave frequency, and the microwave loss of the polymeric material. It is also contemplated that the electrically-conductive particles can be solid particles that comprise an electrically-conducting material and, intrinsically, having an electrically-conducting layer as the outer surface of the particle. Carbon particles or fibers are also contemplated as filler particles for the provided electronic article and method.

The high dielectric composite includes a binder. The binder for the provided high dielectric adhesive composites can be a network of a polymeric material. It can be continuous and can include voids or a gas. It can be solid or foamed and can include microwave transmissive polymers that can function to bind the filler particles together. The binder can be stable at temperatures above about 65° C., above about 95° C. and can be inexpensive to offset the cost of the filler materials retained therein. Binders for the provided electronic articles can be microwave transmissive adhesives.

The binder for the provided compositions can include low dielectric loss (microwave-transmissive) polymers that can range from non-polar materials to polar or aromatic materials. The dielectric loss of materials at high frequencies such as, for example, 1 GHz, typically increases with both polarity and/or aromaticity of the polymer and the amount included in a composition. Therefore, polar or aromatic materials can be useful in the provided compositions if they are present at low levels. Typically, non-polar and saturated materials can be used if high levels of binder are used in the provided compositions. Also, the binder, typically, can have no significant functionality that absorbs microwave frequencies.

The binder for the provided high dielectric adhesive composites can include adhesives. The adhesives can be thermoplastic or thermosetting adhesives. Typical thermoplastic adhesive include, for example, hot melt adhesives. Hot melt adhesive can include natural or synthetic rubbers, butyl rubber, nitrile rubbers, synthetic polyisoprene, ethylene-propylene rubber, ethylene-propylene-diene monomer rubber (EPDM), polybutadiene, polyisobutylene, poly(alpha-olefin), styrene-butadiene random copolymer, fluoroelastomers, silicone elastomers, and combinations thereof. Typical thermosetting adhesives can be epoxy-based adhesives such as, for example, ethylene-glycidyl (meth)acrylate copolymers, phenolic-based adhesives, or (meth)acrylic adhesives. These adhesive can be crosslinked thermally, reactively (including moisture-cured), or photochemically. The provided binders can include acrylic pressure-sensitive adhesives. Typically, the acrylic pressure-sensitive adhesives are substantially solventless and are UV or visible-light curable.

The binder can be formulated in a solvent, mixed with filler, coated onto a liner or onto a substrate layer which may or may not be a layer of the provided electronic article. The solvent can be removed by drying. The binder can include additives such as cross-linkers that can be activated to cross-link the binder, if desired. Cross-linker additives can include difunctional molecules that can react at both ends to cross-link the binder during the coating and drying process or they can include thermal or photochemical initiators that can be activated by heat or radiation.

Solventless acrylic pressure-sensitive adhesives can be made from precursors that can comprise a polar monomer and a non-polar monomer. The non-polar monomer can comprise, for example, an acrylic acid ester of non-tertiary alcohol, the alkyl groups of which have an average of about 4 to 14 carbon atoms, and a polar co-monomer. Suitable acrylic acid esters include, for example, isooctyl acrylate, 2-ethylhexyl acrylate, butyl acrylate, n-hexyl acrylate, and stearyl acrylate. Suitable polar co-monomers can include, for example, acrylic acid, acrylamide, methacrylic acid, itaconic acid, certain substituted acrylamides such as dimethylacrylamide, N-vinyl-2-pyrrolidone, N-vinyl caprolactam, tetrahydrofurfuryl acrylate, benzylacrylate, 2-phenoxyethylacrylate, and combinations thereof. The polar co-monomer can comprises from about 1 to about 50 parts by weight of the acrylic pressure-sensitive adhesive precursors.

The solventless acrylic pressure-sensitive adhesive precursors may also comprise multifunctional acrylate monomers. Such multifunctional acrylate monomers include for example glycerol diacrylate, glycerol triacrylate, ethyleneglycol diacrylate, diethyleneglycol diacrylate, triethyleneglycol dimethacrylate, 1,3-propanediol diacrylate, 1,3-propanediol dimethacrylate, hexanediol diacrylate, trimethanol triacrylate, 1,2,4-butanetriol trimethylacrylate, 1,4-cyclohexanediol diacrylate, pentaerythritol triacrylate, pentaerythritol tetraacrylate, pentaerythritol tetramethacrylate, sorbitol hexacrylate, bis[1-(2-acryloxy)]-p-ethoxyphenyl dimethylmethane, bis[1-(3-acryloxy-2-hydroxy)]-p-propoxyphenyldimethylmethane, tris-hydroxyethyl isocyanurate trimethacrylate, the bis-methacrylates of polyethylene glycols of molecular weight 200-500, and combinations thereof.

The multifunctional acrylate monomers used in the acrylic pressure-sensitive adhesive precursor can comprise from about 0.05 to about 1 part by weight of the precursor.

The monomers and the proportions thereof can be selected to provide a normally tacky and pressure-sensitive adhesive copolymer. Typically, this means that the monomer mixture can contain from about 50 to about 98 parts by weight of the acrylate-type monomer and from about 2 to about 50 parts by weight of the polar monomer co-polymerizable therewith, the sum of these being 100 parts by weight. Typically, more than one acrylate-type monomer and/or more than one polar monomer can be used in a mixture when desired. If desired, additional tackifying materials can be added to the acrylic mixture.

The solventless acrylic PSA precursor can be sensitized by the addition of any known initiator, for example, thermal and photoinitiators. Photoinitiators which are useful for polymerizing the precursor include the benzoin ethers (such as benzoin methyl ether or benzoin isopropyl ether), substituted benzoin ethers (such as anisoin methyl ether), substituted acetophenones (such as 2,2-diethoxyacetophenone and 2,2-dimethoxy-2phenylacetophenone), substituted alpha-ketols (such as 2-methyl-2-hydroxypropiophenone), and photoactive oximes [such as 1-phenyl-1,1-propanedione-2-(O-ethoxycarbonyl)oxime]. Commercially available photoinitiators include, for example, the IRGACURE series of initiators, such as IRGACURE 651, available from Ciba Specialty Chemicals. An effective amount of photoinitiator is used, such that the precursor is polymerized upon exposure to the appropriate light source for the desired exposure time. For example, such photoinitiators typically are used in amount that provides about 0.05 to 5 parts per 100 parts by weight of the total precursor monomers. Useful solventless acrylic pressure-sensitive adhesives are disclosed, for example, in U.S. Pat. Nos. 6,339,111 and 6,436,532 (both Moon et al.).

Photopolymerization of thin layers of the materials disclosed herein can be carried out in an inert atmosphere, to prevent interference from oxygen. Any known inert atmosphere such as nitrogen, carbon dioxide, helium, or argon is suitable, and a small amount of oxygen still can be tolerated. In some embodiments, a sufficiently inert atmosphere can be achieved by covering a layer of the radiation sensitized mixture with a polymeric film that is transparent to the selected ultraviolet radiation and then irradiating through that film in air. Good polymerization results can be attained using a bank of fluorescent black light lamps. Typically, radiation in the near ultraviolet region in the 300-400 nanometer wavelength range at a rate of irradiation of below about 1000 mJoules per square centimeter can be used, with particular selection within the skill of the art guided by the photoinitiator selection and the choice of monomers. Other materials can be blended into the radiation sensitized adhesive precursor mixtures, such as pigments, tackifiers, reinforcing agents, fillers, anti-oxidants etc., which selections and amounts do not interfere with the desired results.

The provided compositions can include screen-printable materials as binders. In this disclosure, the term "screen-printable" refers to low molecular weight organic oligomers or polymers that have a viscosity high enough to form stable dispersions when filled with high dielectric particulates as described above. They may be screen-printed as solventless formulations or include solvents for coating.

Blends of two or more adhesive polymers with or without compatibilizers may also be used as the binder, provided the resultant blend has sufficient mechanical properties for the intended application. At low coated filler loading levels and low frequencies, below about 1 GHz, nearly all polymers will function in the matrix material, even those with significant polarity. Microwave loss increases as coated filler loading increases and as frequency increases, so polymers with less functionality and less aromaticity and no polarity are typically employed. For composite material applications from about 6 to 10 GHz, polyolefins and polytetrafluoroethylene are typically employed. Thus, the provided electronic article includes a composite adhesive material having low loss from the high MHz (above $10^8$ Hz) to the GHz range (above $10^{12}$ Hz).

High dielectric constant fillers for the provided electronic articles can include particles that can include a core body, an electrically-conducting layer substantially encapsulating the body, and an insulating layer at least partially covering the electrically-conducting layer. High dielectric constant fillers useful for the provided electronic devices can have a lower density than typical fillers used to increase the dielectric constant of composite materials, and do not substantially increase the dielectric loss when mixed into the composite material. The filler size, shape, and composition can be selected for a particular application and frequency range with microspheres, acicular fibers, and/or flakes being typically used. The filler can be coated with electrically conductive material, as described below. The density of the particulate filler in the inventive composite material is generally below about 3.5 g/cc (typically below 2.7 g/cc). For some applications, a particulate filler having a density below about 1.0 g/cc can be used. The desired dielectric constant of the composite material for a particular application can be determined by the type and amount of filler used. As the desired dielectric constant increases, materials well known in the art made with titanium dioxide or barium titanate filler must be made with greater filler content and increasing density.

Acicular fibers may comprise polymeric materials, or inorganic materials such as ceramic or milled glass. In some embodiments, the acicular fiber is chopped strand glass fiber (available as FIBERGLAS Milled Fibers 731ED 1/32 inch (762 μm) from Owens Coming, Toledo, Ohio). These fibers have an average diameter of 15.8 μm and an aspect ratio of 40:1. Mica is a typically used inorganic flake. Typically, mica flake material has an average density of 2.9 g/cc and an average surface area of 2.8 $m^2/g$ (available as Suzorite 200HK, from Zemex Industrial Minerals, Inc., Toronto, Ontario, Canada). Hollow microspheres are typically used over fillers traditionally used to enhance a composite dielectric constant, such as titanium dioxide. Such microspheres can be formed from glass, ceramic and/or polymeric materials. Generally, the material for microspheres is glass, but ceramic and polymeric materials are suitable.

In some embodiments, the particulate filler comprises hollow glass microspheres. An average outer diameter in the range of 10 to 350 μm is suitable. The range of average outer diameters of the microspheres can be 15 to 50 μm. The density for the microspheres can be about 0.25 to 0.75 g/cc (typically about 0.30 to 0.65 g/cc), as measured following ASTM D2840. The glass microspheres can be soda-lime-borosilicate glass SCOTCHLITE Glass Bubbles available from 3M Company, St. Paul, Minn. Generally, these microspheres should be strong enough to withstand hydrostatic pressure of at least about 6.9 MPa (1,000 psi) without the microspheres being significantly ruptured. Crushed microspheres increase the composite material density and do not contribute to the desirable low density, low microwave loss features of the present invention. K37 SCOTCHLITE Glass Bubbles meet this objective. These K37 glass bubbles have an average density of 0.37 g/cc, an average diameter of about 40 μm, and an isostatic crush strength of 3,000 psi (20.7 MPa) with a target survival of 90% and a minimum survival of 80%. Even stronger microspheres may be used, such as S60/10,000 SCOTCHLITE Glass Bubbles with an isostatic crush strength of 10,000 psi (68.9 MPa) and an average diameter of about 30 μm, although these have a greater average density of 0.60 g/cc.

The particulate filler can occupy from about 1 to about 80 volume percent, or from about 5 to about 45 volume percent or the high dielectric composite. At levels below about 1 volume percent no significant change in the dielectric constant of the composite material occurs. Levels above about 80 volume percent are less desirable because there may be insufficient matrix material to hold the composite material together. With high loadings of particles, the adhesive composite may become less tacky. In a foamed or starved matrix composite, a significant amount of the remaining 35 volume percent can be air or another gas. Embodiments having filler volume loading factors in the higher end of the range typically include stronger microspheres, e.g. S60/10,000, to avoid significantly rupturing the microspheres when melt processing the composite materials. If the particulate is not inherently electrically-conducting, an electrically-conducting layer, at least partially surrounding the particle, can be provided.

An electrically-conductive coating layer can be provided on the surface of the particulate filler to substantially surround the filler. By "substantially surround" it is meant that at least 50% of the surface area, at least 75% of the surface area, or at least 90% of the surface area of the particles in the particulate, on average, is covered by the electrically-conductive coating. The electrically-conducting layer can be in direct contact with the surface of the particulate filler or it can be adjacent to it. When the electrically-conducting layer is adjacent to the surface of the particles, other layers, typically insulating layers, can be between the outer surface of the particles and the electrically-conducting layer. The electrically-conductive coating materials are selected considering the frequency range of a particular application. Desirable properties are: wetting the surface at the thickness used, low cost, and the availability of the material. Typically aluminum, stainless steel, silver, titanium, and tungsten are utilized.

A discontinuous layer of electrically-conducting material, such as occurs when the coating forms beads on the surface can reduce the dielectric constant. The electrically-conductive coating layer thickness can range from about 5 to 500 nanometers (nm) (more typically from about 10 to 100 nm) for composite materials having low loss in the microwave frequency range. Layers below about 100 nm in thickness are typical for lower density composite materials.

For a given size filler particle, the thickness and type of the electrically conductive coating are important factors in the level of dielectric loss. It has been found that very thin coatings lead to very high microwave loss. While not wishing to be bound by any particular theory, this is believed to be due to coupling with the electric field of the microwave radiation. This type of microwave loss decreases as the electrically conductive coating thickness increases. However, as the electrically-conducting coating thickness increases, microwave loss due to coupling with the magnetic field component of the microwave radiation increases. A minimum microwave loss has now been achieved at an intermediate electrically-conducting coating thickness, at which coupling with both components of the microwave radiation is low.

It is also known to provide a substantially insulating layer on the electrically-conducting layer such that the insulating layer substantially surrounds the particulate filter and also prevents electrical short-circuits when high loadings of such filler particles when the filler particles are dispersed in a matrix material to increase its dielectric constant. Such insulating layers are disclosed, for example, in U.S. Pat. No. 6,562,448 (Chamberlain et al.). Such an insulating layer may be thin, for example about 4 nm. The material for this coating is typically selected for compatibility with the electrically conductive coating in order to avoid undesirable chemical reactions. For example, when aluminum is used for the electrically conductive coating, an aluminum suboxide can be suitable for the insulating layer. In some embodiments, the insulating layer can include ceramics or polymers. Ceramics can include ceramics or non-conducting polymers. Exemplary ceramics include non-conductive metal oxides such as aluminum oxide or silicon oxide.

The insulating layer can be provided by any useful means. In general, this can be accomplished by introducing oxygen into the deposition process under conditions and in quantities sufficient to form oxides of the electrically conductive coating material, such as aluminum oxide when the electrically conducting layer comprises aluminum. Alternatively, the insulating layer can be coated from a solution or from a composite solution according to techniques well known to those of ordinary skill in the art.

The provided high dielectric adhesive composite can be compared to a reference composite material that is similar in composition to the inventive composite material. This reference composite material contains a sufficient quantity of a titanium dioxide or barium titanate filler, or another suitable commercially available microwave transmissive filler, to provide a dielectric constant within about 5% of that of the inventive composite material. The inventive composite material contains the fillers of the present invention. The provided composite material typically has a density less than about 95% of the density of the reference composite material (typically less than 85%).

In some embodiments, the filler material for the provided composite can be glass microspheres with four properties: an electrically conductive coating; a non-electrically conductive layer enclosing the electrically conductive coating; a low density; and sufficient strength to be melt-processable. Hollow glass microspheres that have even lower density can also be employed in the provided composite.

Non-electrically conductive filler particles such as glass bubbles or milled glass fibers can be coated with a thin metal film by any useful means, such as by conventional coating techniques. These techniques include: physical vapor deposition methods such as sputter deposition, evaporative coating, and cathodic arc coating; chemical vapor deposition; and solution coating techniques such as electroless plating or mirroring. In each case, proper care must be taken to ensure that the particle surface is properly exposed to the metal source so that the particle may be uniformly coated and to ensure that the proper film thickness is obtained. For example, in sputter deposition, particles can be stirred under metal vapor flux in which the coating thickness is controlled by exposure time and deposition rate. An insulating coating may be provided in a similar process, for example, by depositing metal with concurrent addition of oxygen in the vicinity of the particulate surfaces.

A composite material may be formed by incorporating the coated particles into a thermoplastic material. This can be done by any useful means, for example, by melting the thermoplastic material and mechanically mixing the coated particles into the melt. Typical equipment for such processes include single and twin screw extruders, for which process conditions are typically chosen such that the coated particles are intimately and uniformly blended with the thermoplastic, while not suffering mechanical damage such as abrasion or fracture. The resulting composite materials can be shaped into a final article by any useful means. Examples of such articles include lenses and planar antennas. Melt processing techniques such as injection molding, or heated platen presses may be used.

A continuous matrix can result when the particulate filler is substantially encompassed by the matrix material with no substantial voids. A discontinuous matrix can be formed with lower quantities of matrix material than used for a continuous matrix. The particulate filler can be bound together in the discontinuous matrix, yet a continuous path normally cannot be traced through the network without leaving the matrix material.

A method of assembling a display device is also provided. The provided method includes disposing a conductive element adjacent to a substrate to form a conductive substrate.

Methods of disposing a conductive element, which may be patterned adjacent to substrates have been discussed above. The provided method also includes disposing a transparent conductor adjacent to a transparent substrate to form a transparent electrically-active substrate. The transparent conductor can be applied adjacent a transparent substrate by any means known by those of ordinary skill in the art and includes the same methods used to dispose a conductive element adjacent a substrate. In some embodiments, the transparent conductor comprises indium-tin-oxide and the transparent substrate includes glass. An electrically-active layer, as defined above, is deposited or disposed adjacent to the transparent conductor so that it is at least partially in contact with the transparent electrically-active substrate. In some embodiments the conductive element can be disposed directly on the substrate, the transparent conductor can be disposed directly the transparent substrate and the high dielectric composite contacts either the conductive element on the conductive substrate, the electrically-active substrate or both. A high dielectric composite as defined above can then be applied to either the conductive element on the conductive substrate, the electrically-active layer on the transparent electrically-active substrate, or both. Finally, the conductive substrate can be laminated to the transparent electrically-active substrate so that the high dielectric adhesive composite contacts the conductive element on the conductive substrate and the electrically-active layer on the transparent electrically-active substrate to form the display device. The high dielectric composite can be a pressure-sensitive adhesive composite. Alternatively, the high dielectric composite can be non-adhesive. In this case, a clamp or clamp-like device such as a frame can be used with pressure to assemble the layers and hold them together so that the device functions properly.

Some embodiments of the provided methods and electronic articles can be better understood by the Drawings. FIG. 1 is a schematic of a particle included in fillers useful in some embodiments of provided electronic articles. In FIG. 1, particle 100 is composed of the non-conductive body, a glass microsphere 104, which is hollow and encloses air 102. Electrically-conducting metal layer 106 substantially encapsulates non-conductive body 104. Insulating layer 108, which is a non-conductive metal oxide, substantially encapsulates electrically-conducting layer 106. Particle 100 can be incorporated into a binder as a part of a high dielectric adhesive useful in the provided electronic articles and methods disclosed herein.

Figure 2A:
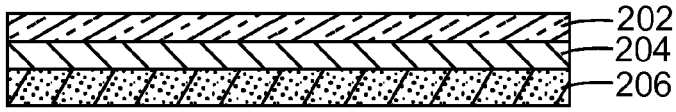
FIGS. 2*a* and 2*b* are schematic drawings of components useful in the provided methods.
Figure 2B:
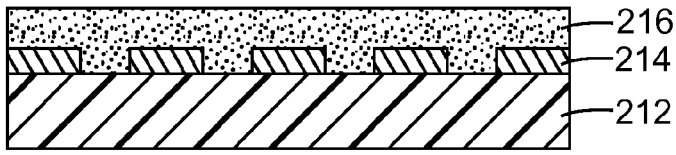

FIGS. 2*a* and 2*b* are schematic drawings of components useful in the provided methods. In one embodiment, transparent electrically-active substrate (FIG. 2*a*) has glass substrate 202 upon which has been disposed transparent metal oxide layer 204 (indium-tin-oxide). Conductive substrate (FIG. 2*b*) has patterned metal conductive element 214 disposed upon flexible polymeric substrate 212 (polyimide in some embodiments). Patterned metal conductive element 214 and the portions of the substrate not covered by patterned metal conductive element 214 are covered with high dielectric adhesive composite 216.

Figure 2C:
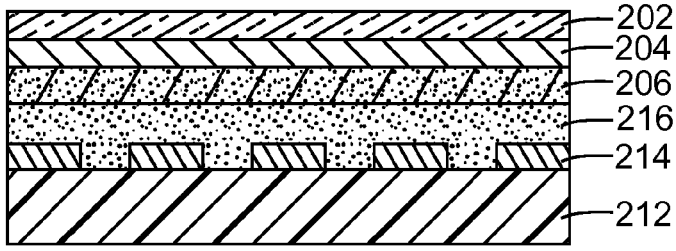
FIG. 2*c* is a schematic of an embodiment of a provided electronic article.

FIG. 2*c* is a schematic of an embodiment of a provided electronic article (electroluminescent lamp 200) in which transparent electrically-active substrate (FIG. 2*a*) has been laminated to conductive substrate (FIG. 2*b*). The electronic article shown in FIG. 2*c* has patterned metal conductive element 214 disposed upon substrate 212. High dielectric adhesive composite 216 contacts conductive substrate 214 and electrically-active layer 206 which is a phosphor. Transparent conductor 204 (indium-tin-oxide) is disposed upon phosphor layer 206. Transparent conductor 204 is disposed upon glass transparent substrate 202.

The provide articles and methods can be incorporated into display devices that can be used on electronic devices. Exemplary electronic devices include actuators, artificial muscles and organs, smart materials and structures, micro-electro-mechanical (MEMS) devices, micro-fluidic devices, acoustic devices, electroluminescent lamps, electronic ink and paper, electronic readers, and sensors.

Objects and advantages of this invention are further illustrated by the following examples, but the particular materials and amounts thereof recited in these examples, as well as other conditions and details, should not be construed to unduly limit this invention.

EXAMPLES

Preparation of Coated Particles

Coated particles used as high dielectric fillers in the examples are glass bubbles/fibers/ceramic microspheres coated with a highly conducting metal layer first and an electrically insulating layer in the outer. These coatings were produced by the physical vapor deposition of respective metals. Other fillers such as metal particles, and carbon particles were coated with an electrically insulating outer layer such as aluminum oxide by physical vapor deposition to provide high dielectric constant fillers.

Figure 3A:
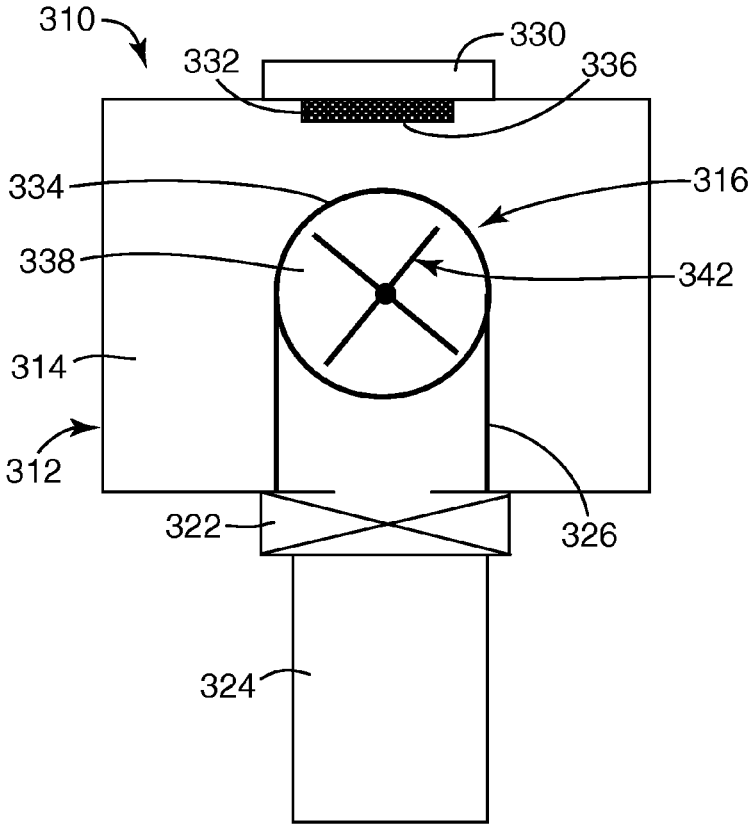
FIGS. 3*a* and 3*b* are schematic drawings of an apparatus for carrying out a physical vapor deposition step useful in the manufacture of provided electronic articles.
Figure 3B:
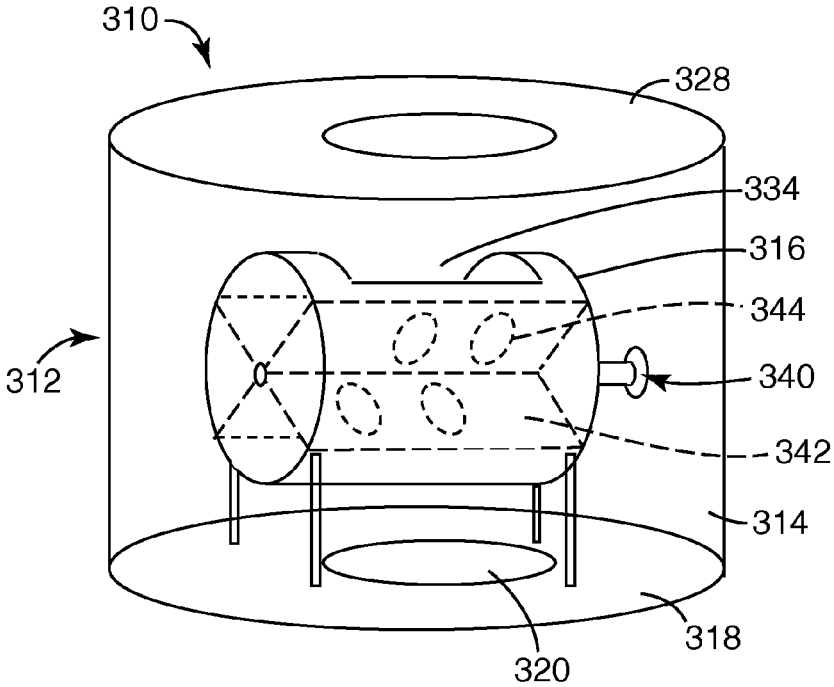

An apparatus 310 for carrying out the PVD process is shown in FIGS. 3*a* and 3*b*. The apparatus 310 includes a housing 312 defining a vacuum chamber 314 containing a particle agitator 316. The housing 312, which may be made from an aluminum alloy if desired, is a vertically oriented hollow cylinder (45 cm high and 50 cm in diameter). The base 318 contains a port 320 for a high vacuum gate valve 322 followed by a 15 cm diffusion pump 324 as well as a support 326 for the particle agitator 316. The chamber 314 is capable of being evacuated to background pressures in the range of $10^{-6}$ torr.

The top of the housing 312 includes a demountable, rubber L-gasket sealed plate 328 that is fitted with an external mount for dc magnetron sputter deposition source 330 (a US Gun II, US, INC., San Jose, Calif.). Into the source 330 is fastened a metal sputter target 332 (13 cm×20 cm and 1.25 cm thick). The sputter source 330 is powered by an MDX-10 Magnetron Drive (Advanced Energy Industries, Inc, Fort Collins, Colo.) fitted with an arc suppressing Sparc-le 20 (Advanced Energy Industries, Inc, Fort Collins, Colo.).

The particle agitator 316 is a hollow cylinder (24 cm long× 19 cm diameter horizontal) with a rectangular opening 34 (16.5 cm×13.5 cm) in the top 336. The opening 334 is positioned 7 cm directly below the surface 336 of the sputter target 332 so that sputtered metal atoms can enter the agitator volume 338. The agitator 316 is fitted with a shaft 340 aligned with its axis. The shaft 340 has a rectangular cross section to which are bolted four rectangular blades 342 which form an agitation mechanism or paddle wheel for the support particles being tumbled. The blades 342 each contain two holes 344 to promote communication between the particle volumes contained in each of the four quadrants formed by the blades 342 and agitator cylinder 316. This particle agitator can hold up to 2000 $cm^3$ volume of glass bubbles or other substrates. Typical modes of use of this apparatus are described below in the examples.

Powder Electrical Resistivity Test

The volume electrical resistivity of the coated particles was measured using a test cell build in-house. The test cell consisted of a DERLIN block containing a cylindrical cavity with cross section of 1.0 $cm^2$. The bottom of the cavity was covered by a brass electrode. The other electrode was a 1.0 $cm^2$ cross section brass cylinder which fitted into the cavity. The coated particles to be tested were filled in the cavity to 1.0 cm high from the bottom electrode. Then the brass cylinder was inserted and a weight was placed on top of the brass cylinder such that the exerted total pressure is 18 psi (124 kPa) on the powder. The electrodes were connected to a digital multimeter to measure resistance. This configuration provides the measured resistance is equivalent to the volume resistivity of the particles.

Composites Containing Coated Particles

Polyethylene Composites

The coated particles were added to the polymer melt (polyethylene—ENGAGE 8200, Dow) in a Brabender batch mixer maintained at a temperature of 160° C. The composite was formed by blending the two materials together by rotating blades at 65 rpm for approximately 15-20 minutes. A flat film of the composite was formed by first placing molten composite between 2 pieces of polyester liner to form a 3-layer sandwich. The sandwich was subsequently placed between 2 aluminum plates. The whole assembly was then inserted into a heated Carver lab press (Model 2518, Fred S. Carver Co., Wabash, Ind.) and molded into a flat film at a pressure of 1000 psi (6900 kPa) and temperature of 150° C. Shims were inserted between the aluminum plates to control the thickness of each sample. Each composite film had a diameter of approximately 18 cm and a thickness of 1.0-1.5 mm.

Epoxy Composites:

Epoxy composites were made using 2-part DEVCON 5 Minute epoxy (Devcon, Danvers, Mass.). Known weight of coated particles and the 2-part epoxy was mixed thoroughly in a plastic beaker with a spatula. After 2 minutes the mixture was poured on a release liner which was placed on an aluminum plate. Another release liner was placed on top of the mixture and an aluminum plate. Shims were inserted to achieve desired thickness. The sandwich assembly was then inserted into a Carver lab press maintained at room temperature. A pressure of 5000 psi (35 MPa) was applied and kept for a minimum of 1 hour.

Each composite had a diameter of 10 cm and a thickness of 1.5-2.0 mm.

Dielectric Measurements—(Used for Examples 1-5)

The dielectric properties of the composites were measured at room temperature (23° C.) using a LCR meter (Model 72-960, TENMA, Centerville, Ohio) at low frequencies up to 1 kHz. The bottom electrode was a 10 cm diameter aluminum plate. The top electrode was a 4 cm diameter aluminum plate. The plate thickness was 1.4 cm. The bottom electrode was connected the negative end, and the top electrode was connected to the positive terminal of the LCR meter. Flat composite samples were placed between the electrodes. A weight equivalent of 18 psi (124 kPa) force was placed on top electrode to exert close contact between the electrodes and the sample surface. The measured capacitance (in picoFarad, pF) was used to calculate the dielectric constant (k) of the composite using the formula, $$K=C*d/e_0*A$$

where C is the measured capacitance in pF, d is the thickness of the slab in meters, A is the area of cross section of the top electrode=50 $cm^2=5\times10^{-3}$ meter, and $e_0=8.85\times10^{-12}$ F/m.

Example 1 and Comparative Examples

Commercially available high dielectric constant (k) filler was used in the Comparative Examples. $BaTiO_3$ exhibits a very high dielectric constant of ~1200. $BaTiO_3$ was purchased from Ferro Corporation, Cleveland, Ohio. 638.46 g of 3M SCOTCHLITE S60 glass bubbles were loaded in the particle agitator and the glass bubbles were coated with aluminum by sputter deposition. A power of 3 kW was applied to the target and the coating was carried out for 24 hours. The chamber was vented with air and a small (10 $cm^3$) of the sample was taken out for powder resistivity measurement. A resistivity of 3.5 ohm-cm was achieved. The outer insulating layer was applied by reactive sputter deposition of aluminum with a partial oxygen atmosphere using a flow of 3.0 sccm through the chamber. A power of 3 kW for 8 hours produced the insulation layer. The chamber was vented and the particles were removed. The measured powder resistivity was above 30 megaohm/cm.

Epoxy composites were prepared for a filler concentration of 10, 20, 30, 40, and 50 volume %. Dielectric constant values were measured and are listed below in Table 1:

TABLE 1

Dielectric Constant of Epoxy Composites with Ceramic Fillers

| Epoxy composites | 0% | 10% | 20% | 30% | 40% | 50% |
|---|---|---|---|---|---|---|
| BaTiO3 powder filler | 3.5 | 4.3 | 5.1 | 6.7 | 7.7 | — |
| Aluminum coated glass bubbles (Al/AlOx coated S60) filler | 3.5 | 4.5 | 6.3 | 7.2 | 9.1 | 12 |

Example 2

The following fillers were prepared by physical vapor deposition of metal and metal oxide coating on different sizes of 3M glass bubbles. The composites were made in polyethylene matrix and the dielectric constant values are listed below in Table 2.

TABLE 2

Dielectric Constant of Polyethylene Composites with Ceramic Fillers

| PE composites | 0% | 10% | 20% | 30% | 40% | 50% |
|---|---|---|---|---|---|---|
| $Al/AlO_x$ coated S60 | 2.5 | 3.1 | 3.7 | 5.2 | 7.1 | 12.1 |
| $W/AlO_x$ coated iM30K | 2.5 | 3.0 | 4.2 | 5.8 | 8.1 | 12.7 |
| $W/AlO_x$ coated A20 | 2.5 | 2.8 | 3.2 | 3.7 | 4.4 | 4.9 |
| Uncoated A20 | 2.5 | 2.6 | 2.5 | 2.7 | 2.7 | 3.2 |

Example 3

RCF 600 glass flakes were purchased from NGF Canada. The glass flakes were coated with tungsten, followed by an aluminum oxide insulating layer to produce the high dielectric filler. 409.64 g of RCF-600 glass flakes were loaded in the particle agitator and coated with tungsten metal first using a tungsten metal target. A cathode power of 3.00 kW was applied for 9 hours. After the coating, the resistivity of the filler was checked using the powder resistivity set up. The resistivity was observed to be 1.0 ohm-cm. The outer insulation $AlO_x$ layer was deposited using an aluminum sputter target. A cathode power of 2.00 kW was applied for 7 hours with partial oxygen atmosphere in the sputter chamber. A flow of 5.0 sccm of oxygen was introduced in the chamber along with argon. The sputter process pressure was kept at 10 millitorr. The filler showed a powder resisitivity in the Mega ohm-cm range. Composites were made in polyethylene and the dielectric constant values are listed in Table 3.

TABLE 3

Dielectric Constants of Polyethylene Composites with Glass Fillers

| PE composites | 10% | 20% | 30% | 40% | 50% |
|---|---|---|---|---|---|
| W/$AlO_x$ coated Glass Flakes | 3.0 | 3.6 | 4.7 | 6.7 | 9.2 |

Example 4

AlOx insulating layer was sputter deposited on Cabot's Vulcan carbon black (XC72R). The dielectric constant values were measured and are listed in Table 4 in comparison to un-coated carbon black. The high loss tangent values indicate that the un-coated carbon black is a lossy material (high dielectric loss).

TABLE 4

Polyethylene Composites with Carbon Black Fillers

| 12% volume, in PE | Dielectric constant | Loss tangent |
|---|---|---|
| Vulcan Carbon | 53.0 | 0.20 |
| $AlO_x$ insulation layer coated Vulcan carbon | 4.8 | 0.004 |

Example 5

Aluminum powder (1-3 microns) were purchased from Atlantic Equipment Engineers, Bergenfield, N.J. An insulating AlOx layer was deposited by reactive sputtering. The dielectric constant and loss tangent values (in brackets) are listed in Table 5.

TABLE 5

Dielectric Constant and Loss Tangent of Ceramic-Filled Epoxy Composites

| Composite in Epoxy Matrix | 0% | 25% | 30% | 40% |
|---|---|---|---|---|
| $AlO_x$ coated Aluminum powder | 3.5 (0.008) | 7.0 (0.010) | 6.7 (0.010) | 9.8 (0.011) |

Test Methods for Example 6

Peel Force Test

An adhesive film sample was laminated, with a one inch rubber roller and hand pressure of about 0.35 kilograms per square centimeter, to a 45 μm thick polyethylene terephthalate (PET) film. A one inch (25.4 cm) wide strip was cut from the adhesive film/PET laminate. This adhesive film side of the test strip was laminated, with a two kilogram rubber roller, to a stainless steel plate which had been cleaned by wiping it once with acetone and three times with heptane. The laminated test sample was allowed to remain at ambient conditions for one hour. The adhesive film sample/PET test sample was removed from the stainless steel surface at an angle of 180 degrees at a rate of 30.5 centimeters per minute. The force was measured with an Imass Model SP-2000 (Imass Inc., Accord, Va.) tester.

Method for Measuring Dielectric Properties (Example 6)

Sample configuration: Films or thin sheets of thicknesses approximately 1 mm and Diameters of 40 mm. For liquid materials, special liquid cells, spacer separated metal electrodes or comb-electrodes are available The Parallel Plate electrode configuration was selected for this measurement. Ordinary direct measurement techniques for DC conductivity could not be applied due to the difficulty of handling these gel samples.

The dielectric measurements were obtained per ASTM D150 entitled, "Standard Test Methods for AC Loss Characteristics and Permittivity (Dielectric Constant) of Solid Electrical Insulation", using parallel plate electrodes and an Andeen Hagerling 2500A 1 kHz Ultra High Precision Capacitance Bridge. Each adhesive sample was carefully stacked to the targeted total thickness (approximately 1.8-1.9 mm), taking caution to avoid creating air bubbles in the sample. The stacked adhesive sample was inserted in between two polished brass disks of 40 mm diameter and 2 mm thickness. Subsequently, the brass electrode sandwiched assembly with sample was inserted into a Mopsik fixture in order to form an interface between the parallel plate sample capacitor and an Andeen Hagerling 2500A 1 kHz Ultra High Precision Capacitance Bridge. A small correction was applied for each measurement, in order to account for the capacitance of fringing fields caused by the finite size of each capacitor.

The dielectric constant and DC Electrical Conductivity of the sample was measured in a parallel plate configuration (see photo above) with the Novocontrol High Temperature Broadband Dielectric Spectrometer (0.01-10 MHz). The DC conductivity can be obtained from the low frequency extrapolation by fitting the imaginary permittivity data (dielectric loss) vs. frequency to a single dielectric relaxation process acting simultaneously with the DC conduction mechanism. Using this multi-parameter fit we could insure that remnant effects of the low frequency dielectric relaxation mechanism were removed from the Conductivity. The results obtained for Teflon and PMMA agree well with what has previously been reported in the literature. The maximum resolution of this electrical conductivity measurement technique deemed accurate is approximately $e^{-17}$ S/cm.

Examples 6A-6D

Preparation of Dielectric Filler—A

The apparatus described in the detailed description and shown in FIGS. 1 and 2 was used as follows to prepare Dielectric Filler A. 3M S60 glass bubbles particle size range from 15-65 microns with a median of 30 microns. 1400 cc (430 g) of S60 SCOTCHLITE glass bubbles particles were dried for 6 hours at 150° C. in a convection oven. The dried particles were placed into the particle agitator apparatus 10, and the chamber 14 was then evacuated. Once the chamber pressure was in the $10^{-5}$ torr range, argon sputtering gas was admitted to the chamber 14 at a pressure of about 10 millitorr. Aluminum metal was used as sputter target. The deposition process was then started by applying a cathodic power of 2.50 kilowatts. The particle agitator shaft 40 was rotated at about 4 rpm during the aluminum deposition process. The power was stopped after 20 hours. An $AlO_x$ layer was coated on top by admitting oxygen gas at a rate of 5 sccm (standard cubic centimeter per minute), in addition to argon sputter gas. The total pressure was kept at 10 millitorr. A cathodic power of 2.00 kW was applied for 18 hours with particle agitation of 4 rpm. At the end of 18 hours, the chamber was vented to ambient conditions and the particles were removed from the agitator. The powder resistivity of the aluminum-coated S60 glass bubbles were less than 2 ohm-cm, and the powder resistivity of the final coating was in Mohm-cm range.

Preparation of Dielectric Filler B.

Process for the preparation of Dielectric Filler B

The apparatus described in the detailed description and shown in FIGS. 1 and 2 is used as follows to prepare Dielectric Filler B according to the following procedure. iM30K SCOTCHLITE glass bubbles (available from 3M Company, St. Paul, Minn.) have an average particle size of 18 microns. 503.95 g of iM30K SCOTCHLITE glass bubbles particles were dried for 6 hours at 150° C. in a convection oven. The dried particles were placed into the particle agitator apparatus 10, and the chamber 14 is then evacuated. Once the chamber pressure is in the $10^{-5}$ torr range, the argon sputtering gas was admitted to the chamber 14 at a pressure of about 10 millitorr. Tungsten rectangular metal was used as sputter target. The deposition process was then started by applying a cathodic power of 3.00 kilowatts. The particle agitator shaft 40 was rotated at about 4 rpm during the tungsten deposition process. The power was stopped after 13 hours. The powder resistivity of tungsten coated glass bubbles was 0.6 ohm cm. AlOx layer was coated on top by admitting oxygen gas at a rate of 5 sccm (standard cubic centimeter per minute), in addition to Argon sputter gas. The total pressure was kept at 10 millitorr. A cathodic power of 2.00 kW was applied for 7 hours with particle agitation of 4 rpm. At the end of 7 hours, the chamber was vented to ambient conditions and the particles were removed from the agitator. The powder resistivity of the final coating was in Mohm-cm range.

Syrup A—A mixture of 80% N-vinyl pyrrolidone and 20% acrylamide (by weight) was mixed together to form an NVP/acrylamide mixture. 10 weight percent (wt %) of this mixture, 16.99 wt % additional N-vinyl pyrrolidone, and 72.97 wt % isooctyl acrylate were mixed with 0.04 wt % IRGACURE 651. The mixture was partially-polymerized to form a syrup as taught in U.S. Pat. No. 6,339,111 (Moon et al.). Additional IRGACURE 651 (0.369 wt %) and 0.149 wt % 1,6-hexanediol diacrylate (HDDA), based upon the weight of partially-polymerized syrup, were added to the partially-polymerized syrup to form Syrup A.

Examples 6A-6D

Example 6A

Composite Containing Dielectric Filler A (20 wt % Loading)

In a 500 mL plastic beaker was placed 240 grams of Syrup A and 60 grams of Dielectric Filler A. The material was then mixed using a standard laboratory blade mixer, and then degassed under reduced pressure for 5 minutes. The material was then coated between a 1.5 mil (38 μm) CPFilms T-10 liner and a 2 mil (50.8 μm) CPFilms T-30 liner at 13 ft/min (4 m/min) to a thickness of 2 mil (50.8 μm). The coating was irradiated with fluorescent black light lamps such that the energy received at the surface of the adhesive coating was approximately 270 mJ/cm$^2$. The dielectric constant of this material was found to be 7.19 at 1 kHz. The dielectric test sample was prepared by laminating together the 2.0 mil (50.8 μm) adhesive to form a 2 mm thick sample.

Example 6B

Composite Containing Dielectric Filler A (30 wt % Loading)

In a 500 mL plastic beaker was placed 210 grams of Syrup A and 90 grams of Dielectric Filler A. The material was then mixed using a standard laboratory blade mixer, and then degassed for 5 minutes. The material was then coated at 13 feet/min (4 m/min) between to a thickness of 2.0 mil (50.8 μm). The coating was irradiated with fluorescent black light lamps such that the energy received at the surface of the adhesive coating was approximately 270 mJ/cm$^2$. The dielectric constant of this material was found to be 15.71 at 1 kHz. The dielectric test sample was prepared by laminating together the 2.0 mil (50.8 μm) adhesive to form a 2 mm thick sample.

Example 6C

Composite Containing Dielectric Filler B (25 wt % Loading)

In a 1 gallon container was placed 487.5 grams of Syrup A, 368.55 grams isooctyl acrylate, 118.95 grams N-vinyl pyrrolidone, and 325 grams of Dielectric Filler B. The material was mixed using a standard laboratory blade mixer, and then degassed under reduced pressure for 15 minutes. The solution was then coated at 15 feet/min (4.5 m/min) between a 1.5 mil (38 μm) CPFilms T-10 liner and a 2 mil (50.8 μm) CPFilms T-30 liner to a thickness of 0.9 mil (23 μm). The coating was then irradiated with fluorescent black light lamps such that the energy received at the surface of the adhesive coating was approximately 270 mJ/cm$^2$. The dielectric constant of this material was found to be 9.68 at 1 kHz. The dielectric test sample was prepared by laminating together the 0.9 mil (23 μm) adhesive to form a 1 mm thick sample.

Example 6D

Composite Containing Dielectric Filler B (35 wt % Loading)

In a 1 liter container was placed 92.87 grams of Syrup A, 70.20 grams isooctyl acrylate, 22.66 grams N-vinyl Pyrrolidone, and 100 grams of Dielectric Filler B. The material was mixed using a standard laboratory blade mixer, and then degassed under reduced pressure for 15 minutes. The solution was then coated at 15 feet/min between a 1.5 mil (38 μm) CPFilms T-10 liner and a 2 mil (50.8 μm) CPFilms T-30 liner to a thickness of 0.9 mil (23 μm). The coating was then irradiated with fluorescent black light lamps such that the energy received at the surface of the adhesive coating was approximately 270 mJ/cm$^2$. The dielectric constant of this material was found to be 15.00 at 1 kHz. The dielectric test sample was prepared by laminating together the 0.9 mil (23 μm) adhesive to form a 1 mm thick sample.

Peel Adhesion

Peel adhesion (180 degree) was measured on the adhesives prepared in Examples 6A-6D, and this data is listed in the table below. A 1 inch (2.54 cm) wide adhesive sample was adhered between a 1 inch (2.54 cm) wide/2 mil (51 μm) thick aluminum foil and a 2 inch (5.08 cm) wide/1.23 mm thick stainless steel test plate. After preparation of the test sample, a 1 hour dwell time was done between sample preparation and 180 degree peel testing. The 180 degree peel test was done at 12 inches (30.5 cm)/minute, with a 2 second data collection delay followed by a 10 second data collection period. Adhesion testing of both the "face side" (FS) and the "back side" (BS) was done. The "face side" of the adhesive was the side of the adhesive exposed when the "easiest-to-remove" liner was removed. The "back side" of the adhesive was the opposite side relative to the "face side". The 180 degree peel tests were done with both the "face side" (FS) and the "back side" (BS) adhered to the stainless steel plate. Finally, the "Transfer %" was recorded as the percent of the adhesive that remained adhered to the stainless steel plate after the 180 degree peel test. The results are displayed in Table 6 below.

TABLE 6

180 Peel of Examples 6A-6A

| Sample | Side | Peel Strength (N/cm) | Transfer % |
|---|---|---|---|
| Example 6A | FS | 6.6 | 20 |
| Example 6A | BS | 7.1 | 37 |
| Example 6B | FS | 5.3 | 25 |
| Example 6B | BS | 4.7 | 50 |
| Example 6C | FS | 4.7 | 100 |
| Example 6C | BS | 5.3 | 0 |
| Example 6D | FS | 3.9 | 100 |
| Example 6D | BS | 4.6 | 50 |

The data in Table 6 shows that the composites of Examples 6A-6D that have high dielectric constants from about 7 to 16 at 1 kH also have significant peel strength and can be useful as high dielectric adhesive composites.

Various modifications and alterations to this invention will become apparent to those skilled in the art without departing from the scope and spirit of this invention. It should be understood that this invention is not intended to be unduly limited by the illustrative embodiments and examples set forth herein and that such examples and embodiments are presented by way of example only with the scope of the invention intended to be limited only by the claims set forth herein as follows. All references cited in this disclosure are herein incorporated by reference in their entirety.

What is claimed is:

1. An electronic article comprising:
a substrate;
a conductive element adjacent to the substrate;
a high dielectric composite, having a first and a second surface, the first surface adjacent to at least a portion of the conductive element; and
an electrically-active layer which is adjacent to at least portion of the second surface of the high dielectric composite,
wherein the high dielectric composite comprises:
a polymeric binder,
from 1 to 80 volume percent of particulate filler retained in the binder,
wherein the filler comprises particles that include:
an electrically-conducting layer; and
an insulating layer substantially surrounds the electrically-conducting layer, and
wherein the electrically-active layer is in electrical communication with the conductive element.

2. An electronic article according to claim 1, wherein the substrate is polymeric material selected from the group consisting of polyimide, polyester, polyethylene, or a combination thereof.

3. An electronic article according to claim 1, wherein the high dielectric composite has a dielectric constant of from about 4 to about 50.

4. An electronic article according to claim 1, wherein the high dielectric composite has a loss tangent of less than 0.1.

5. An electronic article according to claim 1, wherein the binder is selected from an epoxy resin, a cyanate ester resin, a polybutadiene resin, or an acrylic resin.

6. An electronic article comprising:
a substrate;
a conductive element adjacent to the substrate;
a high dielectric composite having a first and a second surface, the first surface adjacent to at least a portion of the conductive element; and
an electrically-active layer which is adjacent to at least portion of the second surface of the high dielectric composite,
wherein the high dielectric composite comprises:
a polymeric binder, wherein the binder comprises a pressure-sensitive adhesive comprising the reaction product of acrylic precursors,
from 1 to 80 volume percent of particulate filler retained in the binder,
wherein the filler comprises particles that include:
an electrically-conducting layer; and
an insulating layer substantially surrounds the electrically-conducting layer, and
wherein the electrically-active layer is in electrical communication with the conductive element.

7. An electronic article according to claim 6, wherein the acrylic precursors comprise at least one non-polar acrylic monomer and at least one polar acrylic monomer.

8. An electronic article according to claim 1, wherein the filler comprises particles that further comprise a core body.

9. An electronic article according to claim 8, wherein the core body comprises a spherical particle, a spheroid particle, a flake, or a fiber.

10. An electronic article according to claim 9, wherein the core body comprises a ceramic or a polymer.

11. An electronic article according to claim 10 wherein the ceramic comprises silicon dioxide.

12. An electronic article according to claim 8, wherein the electrically-conducting layer substantially surrounds the core body.

13. An electronic article according to claim 1, wherein electrically-conducting conducting layer comprises a metal, a metal alloy, or a conductive metal oxide.

14. An electronic article according to claim 1, wherein the insulating layer comprises a ceramic, or a polymer.

15. An electronic article according to claim 14, wherein the ceramic comprises aluminum oxide or silicon oxide.

16. An electronic article according to claim 1 further comprising surface-modified nanoparticles.

17. An electronic article according to claim 1 further comprising a transparent electrode in contact with the electrically-active layer.

18. A display device comprising an electronic article according to claim 15.

19. A method of assembling a display device comprising:
disposing a conductive element adjacent to a substrate to form a conductive substrate;
disposing a transparent conductor adjacent to a transparent substrate;
disposing an electrically-active layer adjacent to the transparent conductor to form a transparent electrically-active substrate;
applying a high dielectric composite adjacent to either the conductive element on the conductive substrate, the electrically-active layer on the transparent electrically-active substrate or both; and laminating the conductive substrate to the transparent electrically-active substrate so that the high dielectric composite is adjacent to both the conductive element on the conductive substrate and the electrically-active layer on the transparent electrically-active substrate to form the display device;

wherein the high dielectric composite comprises:

a polymeric binder, from 1 to 80 volume percent of particulate filler retained in the binder, wherein the filler comprises particles that include:

an electrically-conducting layer; and an insulating layer substantially surrounds the electrically-conducting layer.

* * * * *

UNITED STATES PATENT AND TRADEMARK OFFICE

CERTIFICATE OF CORRECTION

PATENT NO. : 8,698,394 B2
APPLICATION NO. : 13/635445
DATED : April 15, 2014
INVENTOR(S) : Jeffrey W. McCutcheon It is certified that error appears in the above-identified patent and that said Letters Patent is hereby corrected as shown below:

Title Page, item (56), page 2, Column 2

Line 4, delete "Sumposium" and insert -- Symposium --, therefor.

In the Specification

Column 4

Line 32, delete "polymeric" and insert -- Polymeric --, therefor.

Column 4

Line 39, delete "ink jet" and insert -- ink-jet --, therefor.

Column 8

Line 47, delete "hexacrylate," and insert -- hexaacrylate, --, therefor.

Column 9

Line 6, delete "2phenylacetophenone)," and insert -- 2-phenylacetophenone), --, therefor.

Column 15

Line 1, delete "DERLIN" and insert -- DELRIN --, therefor.

Signed and Sealed this
Sixth Day of January, 2015

Michelle K. Lee

Michelle K. Lee
*Deputy Director of the United States Patent and Trademark Office*

Column 15

Line 62, delete “meter,” and insert -- meter$^2$, --, therefor.

Column 17

Line 3, delete “resisitivity” and insert -- resistivity --, therefor.

Column 18

Line 9, after “available” insert -- . --.

In the Claims

Column 22

Line 9, in Claim 6, delete “composite” and insert -- composite, --, therefor.

Column 22

Line 43, in Claim 13, before “layer” delete “conducting”.